US008534325B2

(12) United States Patent
Melle et al.

(10) Patent No.: US 8,534,325 B2
(45) Date of Patent: Sep. 17, 2013

(54) VENTILATION ARRANGEMENT FOR SHOWER STREAMS

(75) Inventors: Fabian Melle, Durbach (DE); Ulrich Kinle, Schenkenzell (DE)

(73) Assignee: Hansgrohe SE, Schiltach (DE)

( * ) Notice: Subject to any disclaimer, the term of this patent is extended or adjusted under 35 U.S.C. 154(b) by 675 days.

(21) Appl. No.: 12/744,273

(22) PCT Filed: Nov. 25, 2008

(86) PCT No.: PCT/EP2008/009955

§ 371 (c)(1),
(2), (4) Date: Jul. 7, 2010

(87) PCT Pub. No.: WO2009/068236

PCT Pub. Date: Jun. 4, 2009

(65) Prior Publication Data

US 2010/0276021 A1 Nov. 4, 2010

(30) Foreign Application Priority Data

Nov. 30, 2007 (DE) ..... 10 2007 058 835

(51) Int. Cl.

| | |
|---|---|
| ***B05B 1/18*** | (2006.01) |
| ***B05B 9/03*** | (2006.01) |
| ***B05B 7/30*** | (2006.01) |
| ***A47K 3/28*** | (2006.01) |
| ***E03C 1/084*** | (2006.01) |

(52) U.S. Cl.
USPC ..... 137/890; 137/895; 4/597; 4/605; 4/615; 239/428.5; 239/311; 239/318

(58) Field of Classification Search
USPC ..... 137/890, 895; 4/596, 597, 605, 4/615; 239/428.5, 318, 311
See application file for complete search history.

(56) References Cited

U.S. PATENT DOCUMENTS

| | | | | |
|---|---|---|---|---|
| 3,207,445 | A | 9/1965 | Court et al. | |
| 5,154,355 | A | 10/1992 | Gonzalez | |
| 5,826,799 | A | 10/1998 | Hsieh | |
| 6,974,245 | B2 * | 12/2005 | Fabries | 366/160.1 |
| 2007/0257136 | A1 | 11/2007 | Kogelbauer | |

FOREIGN PATENT DOCUMENTS

| | | |
|---|---|---|
| CA | 1216613 | 1/1987 |
| CH | 428595 | 7/1967 |
| DE | 3825537 | 2/1989 |
| DE | 4341196 | 6/1994 |
| DE | 10008438 | 8/2001 |

(Continued)

OTHER PUBLICATIONS

Search Report in DE 10 2007 058 835.8.

*Primary Examiner* — Craig Schneider
*Assistant Examiner* — Atif Chaudry
(74) *Attorney, Agent, or Firm* — Duane Morris LLP

(57) ABSTRACT

The invention relates to a ventilation device for ventilating shower streams that is configured as an insert, and that may be utilized in a connection of a sanitary fitting, particularly in the connection of a shower head housing. The insert contains at least one water throughput channel connected to a ventilation channel such that air is suctioned in through the ventilation channel when a flow passes through the water throughput channel, ventilating the water stream. The insert may have a receptacle for a flow restrictor. A backflow preventer may be provided in order to prevent water leakage from the exterior end of the ventilation channel.

15 Claims, 1 Drawing Sheet

(56) References Cited

FOREIGN PATENT DOCUMENTS

Figure 1:
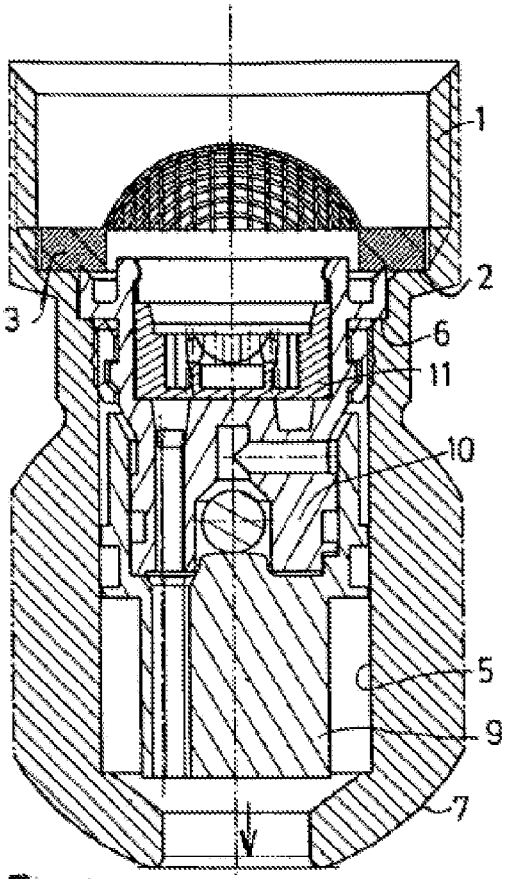

| | | |
|---|---|---|
| DE | 102004059329 | 6/2006 |
| DE | 102006021801 | 11/2007 |
| DE | 202007009643 | 11/2007 |
| WO | 9802250 | 1/1998 |
| WO | 2005054591 | 6/2005 |
| WO | WO 2006058717 A1 * | 6/2006 |

* cited by examiner

VENTILATION ARRANGEMENT FOR SHOWER STREAMS

The invention relates to a device for ventilating shower streams.

It has been known for some time that shower streams are ventilated for aesthetic or for water-saving purposes. Ventilation devices that take in water from outside, due to streaming water, are used for this purpose.

In overhead showers connected by means of a ball joint, with a fixed installation device, it is common to accommodate a ventilation device inside the fixed installation device. The air is then sucked in from outside at the ball joint itself (U.S. Pat. No. 5,154,355). At this point, a gap is formed between a nipple and the actual shower head so that these air inlet openings are practically invisible.

It is also known to attach a tube-like adapter, in which a ventilation device is accommodated (DE 10008438), at the exit of a sanitary fitting.

Further known is a sanitary outlet unit with an outlet fitting in which a ventilation device is provided for ventilating the water stream. This ventilation device is designed as an insert cartridge or installation cartridge and can be used in the line- or fitting section leading to the water outlet (DE 102006021801).

The problem that basically exists in common solutions, for example with changing flow resistance of the shower e.g. due to calcification after a longer operation period or as a result of connecting showers, which are not adjusted to the ventilation device in their flow and flow resistance, is that the dynamic pressure may possibly become too great. Then the ventilation device not only stops working, but water can also flow out of the ventilation opening.

The attachment of an additional element between the hose pipe and the sanitary fitting changes the optical appearance of the sanitary fitting considerably and is therefore used reluctantly due to aesthetics.

The task of the invention is to propose an arrangement for ventilation of water streams which does not feature the above-mentioned disadvantages and which is particularly suitable for retrofitting without impairing the optical impression of a sanitary fitting.

To solve this task, the invention proposes an arrangement with the features of claim 1. Further embodiments of the invention are the object of subordinate claims.

The ventilation device is formed therefore according to the invention as a surrounded insert, whereby this insert contains both the water passage channel and the ventilation channel. Based on the water flow, air is sucked in through the ventilation channel, resulting in the ventilation of water. As an insert, the ventilation device can be retrofitted and, with different design sizes, it can also be used in diverse applications. Thus, it is also relatively easily possible to adapt it to different flow resistances.

In a development of the invention it can be provided that the air inlet opening on the outside of the ventilation device leads into a ventilated space of the connection or of the sanitary fitting. The insert can be accommodated therefore completely in a receptacle of the sanitary fitting or connection of a sanitary fitting. It does not need even need a direct connection to the outside.

In yet another embodiment of the invention it can be provided that the ventilation device features a backflow preventer inside the insert. As a result, it should also be taken into account, among other things, that in an existing installation the stream outlet openings of a shower head or the water supply within the shower head are constricted by calcification material. This constriction would cause a pressure increase and then also a reflux through the inlet opening.

According to the invention, the backflow preventer can be arranged and formed such that it influences only the ventilation device.

A possibility of where the backflow preventer can be disposed is directly in a ventilation channel. This has the advantage that no special adjustment is required where the insert is used.

It is also possible and is proposed by the invention that a backflow preventer is positioned outside of the inlet opening of the ventilation device. It can then be formed in such a manner that it influences a connection between the point where it is used and the inlet opening of the insert.

In yet another embodiment of the invention it can be provided that the arrangement features a flow limiter. This can be mounted with an advantage upstream of the place where the ventilation occurs.

In particular, it can be provided that the insert forming the ventilation device features a receptacle space in which a flow limiter can be accommodated, whereby this flow limiter can be formed as an insert.

In a further embodiment of the invention it can be provided that the ventilation device is formed out of two-parts—an upper part and a lower part. These two parts can be adapted to one another such that a part of the ventilation channel passes at its partitioning point.

The backflow preventer can also be disposed between the upper part and the lower part, and can then be inserted or removed when the two parts are taken apart, and when the parts are assembled together it is held in place and does not get lost.

An example of where the insert with the ventilation device can be arranged is in the connection of a shower head housing, for example in a joint-like connection around which a shower head can be swiveled. This connection joint usually has space in which an insert can be accommodated.

It is also possible, however, for the insert containing the ventilation device to be fitted inside a hose connection nipple.

Figure 2:
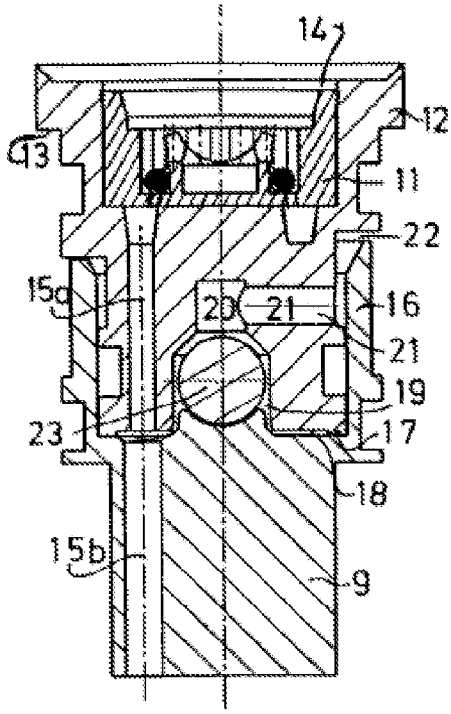
Figure 3:
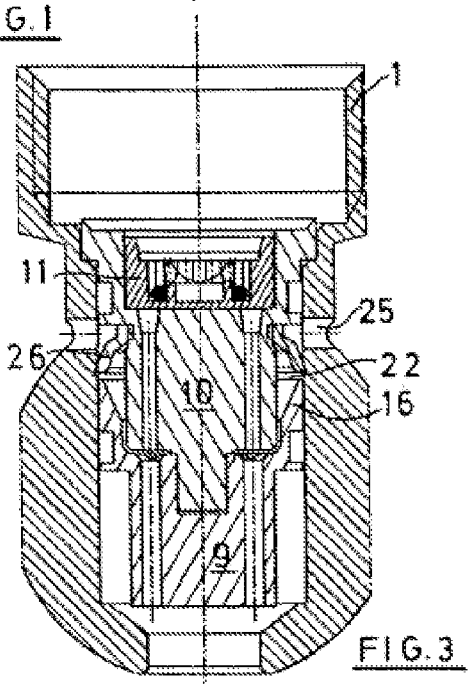
Figure 4:
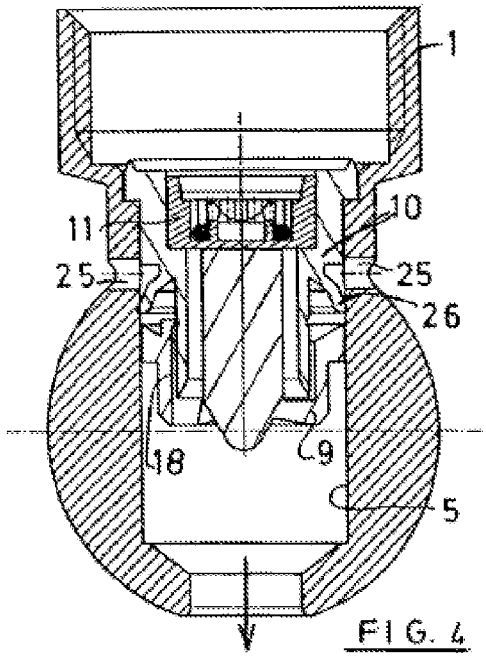

Further features, details and advantages of the invention result from the claims and the summary, the wording which is based on reference to the contents of the description, the following description of preferred embodiments of the invention, as well as from the drawing. Shown hereby:

FIG. 1 a section through a ball joint connection for an overhead shower;

FIG. 2 in an magnified scale, a section through the insert from FIG. 1;

FIG. 3 a section corresponding to FIG. 1 through a further embodiment;

FIG. 4 a section corresponding to FIGS. 1 and 3 through yet a further embodiment.

FIG. 1 shows an axial section through a connection for a shower head, similar to how it could be used in the above-mentioned U.S. Pat. No. 5,154,355. On the upper end of FIG. 1, a screw connection 1 is provided, with which the connection nipple can be screwed on the pipe end of a house installation or of a connection elbow projecting out of the wall or the like. In the hose connection, a contact surface 2 for a seal 3 is depicted, which in the illustrated example also features a sieve.

Beneath the shoulder 2, a cylindrical inner space 5 is formed, which expands in a stepped manner at a short distance in front of the shoulder 2 and forms a further contact shoulder 6.

The actual ball outside surface 7 is only indicated as a dot-dashed line.

In the inner space 5, an insert is disposed, which contains a lower part 9, an upper part 10 and a flow limiter 11. This insert is depicted also in FIG. 2. An upper flange 12 in FIGS. 1 and 2 serves for axial locking, which lies with its underside 13 on the shoulder 6. The flow limiter 11 is formed as an insert and is disposed in a receptacle opening 14. It contains devices in a common manner in order to close passage openings more and more as the flow intensifies. This is not clarified in detail. Openings adjoin at the receptacle space 14 for the flow limiter 11, and these lead to at least one water passage channel 15. The water passage channel 15 contains a first section 15*a* in the upper part 10 of the insert and a second part 15*b* in the lower part 9 of the insert. Both parts are aligned axially.

The lower part 9 surrounds a part of the upper part 10 with a sleeve section 16 and covers its outside using this part. In the interior of the sleeve part 16, the lower part 9 forms a base on which the upper part is supported along its circumference with a ring 17. This forms a flat space 18 where both parts 9, 10 feature a distance from one another. This flat space 18 extends into the partition section between both parts 15*a* and 15*b* of the passage channel 15.

From the underside of the upper part 10, a cylindrical space 19 opens, which constricts and transforms into a blind hole 20. From this blind hole 20, a radially extending bore 21 leads to the outside of the upper part and into a space between the upper part 10 and the sleeve part 16. An inlet opening 22 is formed at the upper end of the sleeve part 16. A ball 23 is accommodated in the cylindrical space 19, which closes the blind hole 20 when it moves upwards. This ball 23 forms a backflow preventer.

When the insert is fitted in the inner space 5 of the connection joint, the flow of water through the passage opening 15 causes air to be sucked in through the ventilation channel 19, 20, 21. This air is taken from the interior of the connection joint that is connected to the outside openings—not depicted in FIG. 1. The insert therefore contains a ventilation device, a backflow preventer for the ventilation device and a flow limiter.

While in the embodiment of FIG. 2 the backflow preventer 23 is arranged as a ball in the ventilation channel between the inlet opening 22 of the insert and the water passage channel 15, FIG. 3 shows a different possibility. Here again the lower part 9 with a sleeve section 16 surrounds the upper parts 10. The upper end of the sleeve part 16 therefore forms an inlet opening 22. A deformable collar 26 is disposed between a radial bore 25 of the connection joint and the inlet opening 22, and this is then deformed if air is not let in and interrupts the connection between the bore 25 and the inlet opening 22. If air is let in, it deforms inwards and opens the connection. In the case of backpressure, this collar 26 also lies on the wall of the inner space 5 and closes the opening of the bore 25. Here, the backflow preventer is therefore disposed at a different place.

A similar arrangement is shown by FIG. 4. Also here a collar 26 is disposed between a radial bore 25 of the connection joint and an inlet opening 22 of the insert. This collar acts in the same manner as in the embodiment according to FIG. 3.

While all depicted embodiments show the insert in a connection joint, for example for a shower head, this insert, depicted in a simplified form in FIG. 2, can also be used at other places, for example, in a connection nipple of a shower hose or, if it involves a fixed outlet of a sanitary fitting, also directly in the outlet or in the sanitary fitting itself. Obviously, the insert can also be used in the shower head itself.

What is claimed is:

1. An arrangement for ventilating shower streams, comprising:

a ventilation device having at least one water passage channel and at least one ventilation channel leading from an air inlet opening on an outside of the ventilation device to the water passage channel;

wherein the ventilation device is formed as an insert for use in at least one of a connection of a sanitary fitting and a sanitary fitting itself;

wherein the ventilation device comprises a backflow preventer;

wherein the at least one water passage channel axially extends through an insert of the ventilation device and is radially offset from a central axis of the insert; and, wherein the backflow preventer comprises a ball arranged in a central axial bore of the insert, the at least one ventilation channel leading from the central axial bore radially outwards to the at least one water passage channel.

2. The arrangement according to claim 1, in which the air inlet opening on the outside of the ventilation device leads into a ventilated space of said one of the connection and the sanitary fitting.

3. The arrangement according to claim 1, in which the backflow preventer influences only the ventilation device.

4. The arrangement according to claim 1, further comprising a flow limiter.

5. The arrangement according to claim 4, in which the flow limiter, viewed in a flow direction, is disposed upstream of the ventilation device.

6. The arrangement according to claim 4, in which the ventilation device has a receptacle space for receiving a flow limitation insert.

7. The arrangement according to claim 1, wherein the ventilation device comprises two parts, including an upper part and a lower part and a part of the ventilation channel extends between said upper and lower parts.

8. The arrangement according to claim 7, in which the backflow preventer is disposed between the upper part and the lower part.

9. The arrangement according to claim 1, wherein the ventilation device is formed for use in a connection of a shower head housing.

10. The arrangement according to claim 9, in which the connection has an air passage leading to the air inlet opening of the ventilation device.

11. The arrangement according to claim 9, wherein the shower head housing is part of an overhead shower.

12. The arrangement according to claim 1, in which the insert containing the ventilation device is formed for use in a hose connection nipple.

13. The arrangement according to claim 1, wherein the sanitary fitting comprises a shower.

14. The arrangement according to claim 1, wherein the ball is supported by an upper face side of a lower part of the insert.

15. The arrangement according to claim 1, wherein the central axial bore comprises a cylindrical portion of constant cylindrical diameter.

* * * * *